US007154232B2

(12) United States Patent
Contenti et al.

(10) Patent No.: US 7,154,232 B2
(45) Date of Patent: Dec. 26, 2006

(54) BALLAST CONTROL IC WITH MULTI-FUNCTION FEEDBACK SENSE

(75) Inventors: Cecilia Contenti, Redondo Beach, CA (US); Peter Green, Redondo Beach, CA (US); Thomas J. Ribarich, Laguna Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 10/875,474

(22) Filed: Jun. 23, 2004

(65) Prior Publication Data

US 2004/0263089 A1 Dec. 30, 2004

Related U.S. Application Data

(60) Provisional application No. 60/482,334, filed on Jun. 24, 2003.

(51) Int. Cl.
*H05B 37/02* (2006.01)

(52) U.S. Cl. ..... 315/225; 315/224; 315/307; 315/291; 315/324

(58) Field of Classification Search ..... 315/291, 315/224–225, 307, 209 R, DIG. 7, DIG. 5, 315/324, 247
See application file for complete search history.

(56) References Cited

U.S. PATENT DOCUMENTS 5,705,894 A * 1/1998 Krummel ..... 315/119
5,930,126 A * 7/1999 Griffin et al. ..... 363/37
5,969,483 A * 10/1999 Li et al. ..... 315/225
6,008,592 A * 12/1999 Ribarich ..... 315/225
6,031,342 A * 2/2000 Ribarich et al. ..... 315/291
6,211,623 B1 * 4/2001 Wilhelm et al. ..... 315/224
6,232,727 B1 * 5/2001 Chee et al. ..... 315/307
6,525,492 B1 * 2/2003 Ribarich ..... 315/291
6,617,805 B1 * 9/2003 Ribarich et al. ..... 315/247
6,822,401 B1 * 11/2004 Borella et al. ..... 315/291

* cited by examiner

*Primary Examiner*—David Vu
*Assistant Examiner*—Chuc Tran
(74) *Attorney, Agent, or Firm*—Ostrolenk, Faber, Gerb & Soffen, LLP

(57) ABSTRACT

A multi-function feedback sense input in an electronic ballast control indicates a number of lamp faults on the basis of lamp parameters exceeding specified thresholds. An end of life detection is achieved by conditioning a lamp feedback with a DC offset to provide a simple threshold comparison to determine if the lamp exceeds specified operational boundaries. An open filament, absent lamp or broken cathode is detected on the same feedback sense by detecting an open circuit in the lamp filament and driving the sense feedback to a shutdown state in the event of a filament open circuit. The ballast control includes a current sense feedback for detecting overcurrent conditions as well as lamp faults so that the control detects an end of life condition, lamp absence, broken lamp, open filament, broken cathode, overcurrent, hardswitching or failure to ignite fault with a minimum number of feedback sensors. The ballast control provides a number of protections with a simplified circuit to reduce cost and improve functionality of the electronic ballast control.

21 Claims, 8 Drawing Sheets

Vspec = Vpk in the spec of the lamp

BALLAST CONTROL IC WITH MULTI-FUNCTION FEEDBACK SENSE

RELATED APPLICATION

This application is based on and claims benefit of U.S. Provisional Application No. 60/482,334, filed Jun. 24, 2003, entitled Ballast Control IC With Multi-function SD Pin, to which a claim of priority is hereby made.

BACKGROUND OF THE INVENTION

1. Field of the Invention

The present invention relates generally to electronic ballast controls for gas discharge lamps, and relates more particularly to an electronic ballast control with circuitry to obtain multi-function feedback sense features.

2. Description of Related Art

Electronic ballasts for controlling fluorescent lamps typically use electronics for preheating the lamp filaments, striking or igniting the lamp, driving the lamp to a given power, detecting lamp fault conditions, and safely deactivating the circuit.

Electronic ballasts for gas discharge circuits have come into widespread use because of the availability of power MOSFET switching devices and insulated gate bipolar transistors (IGBTs) that can replace previously used power bipolar switching devices. A number of integrated circuits (ICs) have been devised for driving gates of power MOSFETs or IGBTs in electronic ballasts. Examples include the IR2155, IR2157, IR2159, IR21571 and IR2167 products sold by International Rectifier Corporation and described in U.S. Pat. Nos. 5,545,955 and 6,211,623, the disclosures of which are incorporated herein by reference in their entireties.

The IR2155 gate driver IC offers significant advantages over prior circuits: The driver is packaged in a conventional DIP or SOIC package. The package contains internal level shifting circuitry, under voltage lockout circuitry, deadtime delay circuitry, and additional logic circuitry and inputs so that the driver can self-oscillate at a frequency determined by external resistors and capacitors.

The IR2157 and IR21571 products provide fully integrated ballast control ICs with several features not available in the IR2155. The IR2157 and IR21571 products function in five basic modes of operation and can make transitions between modes based on IC inputs. The modes include undervoltage lockout (UVLO) mode, preheat mode, ignition ramp, run mode, and fault mode. Other features of these ICs include: (i) a start-up procedure that insures a flash-free start without an initial high voltage pulse across the lamp; (ii) non-zero voltage switching protection circuitry; (iii) overtemperature shutdown circuitry; (iv) DC bus and AC on/off control circuitry; and (v) near or below resonance detection circuitry.

Previously available ballast ICs require external components for power factor correction (PFC) control. An example of a PFC control circuit is described in U.S. Pat. No. 6,259,614 to International Rectifier Corporation, the disclosure of which is incorporated herein by reference in its entirety.

A design challenge in providing electronic ballasts is presented by the "end-of-life detection problem," which arises when a lamp approaches the end of its life. The IR2157, IR2167 and 21571 products described above each have a shutdown (SD) pin, used to shutdown the oscillator, pull gate driver outputs low, and put the IC in an interim micropower state. Input voltage on the SD pin above a threshold indicates lamp fault, lamp exchange, or lamp removal. It would be advantageous to provide circuitry for easier detection of the end of life of a lamp.

To address the end of life detection problem described above, one solution provides a detection of voltage across the lamp to indicate when the lamp is nearing the end of its life. The drive circuitry is disabled when the lamp voltage reaches a given threshold to avoid providing further drive signals to the lamp to prevent any damage to the power switching devices. An upper and lower threshold may be checked to determine if the lamp is operating within the threshold window for proper operation, and determine an end of life condition when the measured voltage is outside of the threshold window. An end of life detection circuit is described in U.S. Pat. No. 6,617,805 to International Rectifier Corporation, the entire disclosure of which is hereby incorporated by reference. The same lamp voltage as that used to determine end of life may be used to determine a lamp fault or lamp removal condition by comparing the measured voltage against another threshold that can be used to determine lamp presence or a lamp fault.

Typically, the voltage across the lamp is measured with a connection that is more or less directly related to the voltage applied to the lamp. Other feedback sensors are also available, such as the detection of current output through the power switching components. The current through the power switching components may be measured as a voltage across a resistor, for example, and various faults can be detected through measurement of the current, such as overcurrent, failure to strike or hard switching. If a fault is detected that indicates a malfunction in the lamp, the electronic ballast control can be reset when a lamp replacement is detected, such as through the voltage measurement across the lamp discussed above.

It would be desirable to consolidate the functions of the various fault detections and resets concerning both the electronic ballast, e.g., the switching half bridge, and the lamp driven by the electronic ballast. It would also be desirable to improve the ability and capacity of the end of life detection, while improving the number of faults capable of detection and responsiveness to those faults.

A current sense that detects current in the power switching components can usually be used to infer when an upper filament is open, or if an upper cathode is broken. The sense circuit detects overcurrent or hard switching in the power switching components, and provides a fault determination for both upper and lower filaments and cathodes. However, in the case of low voltage lamp operation or voltage mode preheat configuration, the electronic ballast may go through preheat and ignition modes even in the case of an open filament in the upper cathode without causing an overcurrent fault. Accordingly, it would be desirable to detect an open filament or broken cathode in the upper or lower portions of the lamp to handle fault conditions in a number of electronic ballast modes.

SUMMARY OF THE INVENTION

In accordance with the present invention, there is provided a multi-function feedback circuit that is incorporated into an electronic ballast control that can detect end of life (EOL) conditions and other faults. An AC EOL, a DC EOL, an open upper filament, an open lower filament, a broken upper cathode, a broken lower cathode and lamp removal can all be detected and the electronic ballast placed in a default mode to prevent component damage. The present invention also provides for an auto restart feature to ignite an exchanged lamp without having to cycle power. The control IC provides a biased sense pin for detection of lamp voltage that provides different responses in different modes. An EOL detector operates in run mode after lamp ignition to compare lamp voltage against a threshold window to detect an EOL. The internal bias permits the EOL circuitry to measure both AC EOL, e.g., symmetrical deterioration in both cathodes, and DC EOL, or asymmetrical end of life indications where deterioration may occur in one cathode only. Due to the sense pin bias, a single comparator may be used to realize EOL detection in these several cases.

According to another feature of the present invention, a feedback circuit from the lamp permits detection of when the lower filament is in open circuit by forcing the feedback sense above a given threshold to cause the system to note a fault and shut down appropriately. Advantageously, when the lamp is changed, the feedback voltage drops below the threshold and an automatic restart is possible. The same configuration may be used to detect an open circuit upper filament, that is, the detection circuit forces a feedback sense above a threshold, to cause the electronic ballast to denote a fault and takes an appropriate response, such as a shutdown.

Other features and advantages of the present invention will become apparent from the following description of the invention, which refers to the accompanying drawings.

DETAILED DESCRIPTION OF THE PREFERRED EMBODIMENTS

Figure 1:
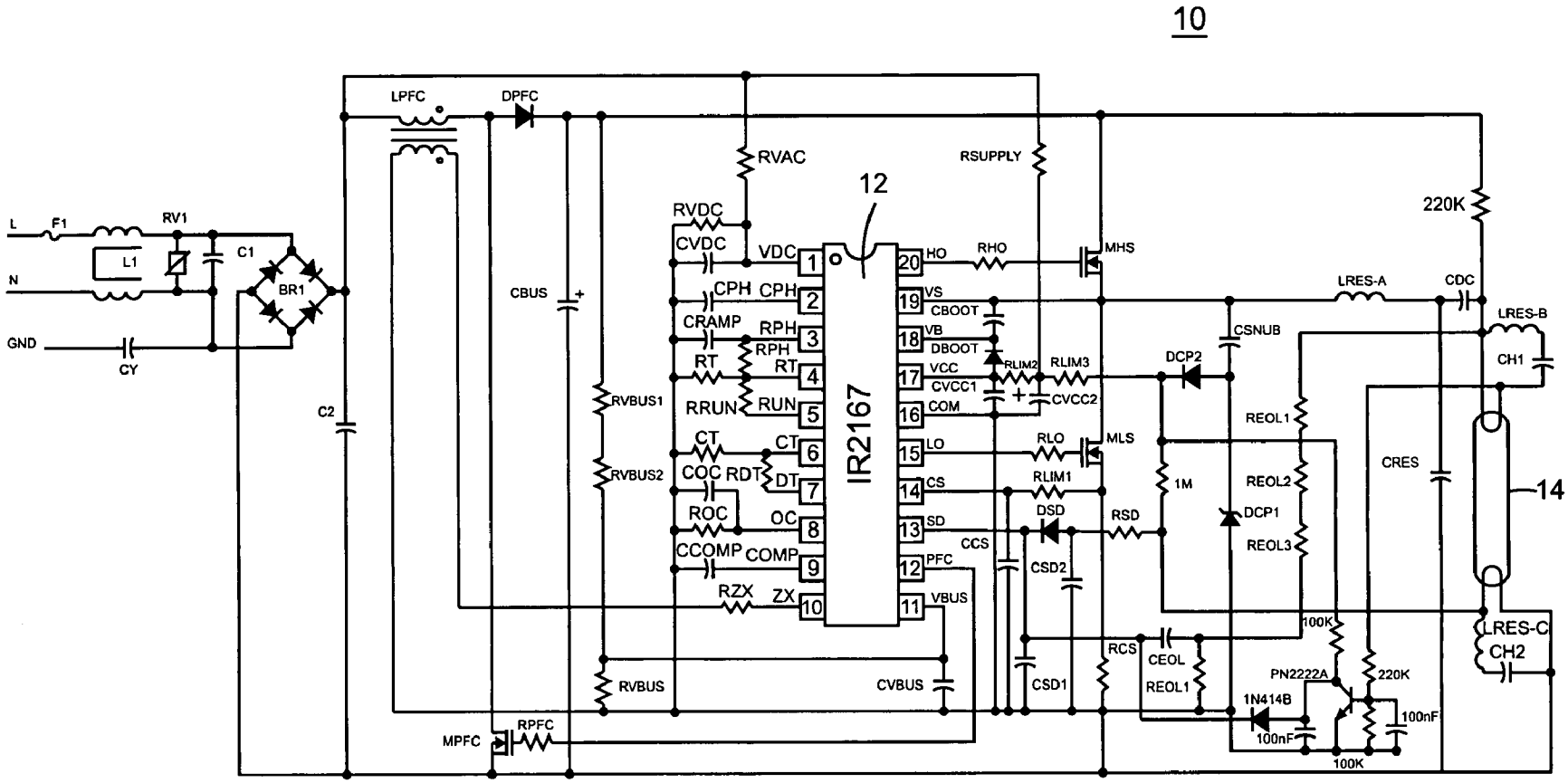
FIG. 1 is a circuit diagram of an electronic ballast with a driven lamp according to the present invention.

Referring now to FIG. 1, a circuit diagram for an electronic ballast is illustrated as circuit 10. Circuit 10 includes an electronic ballast control IC 12 that provides all the operational signals for controlling the electronic ballast. Preferably, control IC 12 provides drive signals to a high and low side switch MHS, MLS, respectively in a switching half bridge to direct power to lamp 14. Circuit connections in circuit 10 shown in dark lines represent high current, high frequency paths. The high frequency, high current paths should be minized in length to avoid or reduce high frequency noise events. Although control IC 12 does not handle high frequency, high current signals, it can easily be seen that control IC 12 controls power switches MHS, MLS and MPFC to direct power in the electronic ballast to operate lamp 14. Control IC 12 also receives feedback from lamp 14 provided on pin SD to measure performance characteristics of lamp 14. Control IC 12 also includes a switching half bridge feedback sense on pin CS that is coupled to the low side of the switching half bridge composed of switches MHS and MLS. By sensing a voltage related to current passing through the switching half bridge, pin CS can derive information about the operation of lamp 14 and the electronic ballast to provide feedback control and fault detection capability.

Circuit 10 also includes a power factor correction (PFC) circuit that makes the electronic ballast appear as a purely resistive load to the input power lines L, N. Control IC 12 switches PFC control switch MPFC to draw a current in inductor LPFC that is substantially in phase with the input sinusoidal voltage. By providing PFC according to this technique, the electronic ballast appears as a resistive load on the input power lines, while a regulated DC power is provided to the electronic ballast. The PFC technique is described in greater detail in U.S. Pat. No. 6,259,614, to International Rectifier Corporation, and uses four connections to provide a complete PFC control to regulate input current and DC bus voltage.

Control IC 12 supervises a number of features for operating an electronic ballast to drive a fluorescent lamp, such as preheat, programmable frequencies for operating modes, fault detection and current sense feedback. These features are described elsewhere, and are not dealt with in detail in this instance.

Control IC 12 includes an SD pin that is coupled to lamp 14 to determine operating conditions of lamp 14 and associated circuitry. According to an exemplary embodiment to the present invention, signals supplied from lamp 14 to pin SD are manipulated or conditioned to permit the determination of a number of fault conditions, including various end of life (EOL) conditions such as AC EOL, DC EOL, open upper filament, open lower filament, broken upper cathode, broken lower cathode and lamp removal. The SD pin also provides for an auto restart if the lamp is exchanged.

Figure 2:
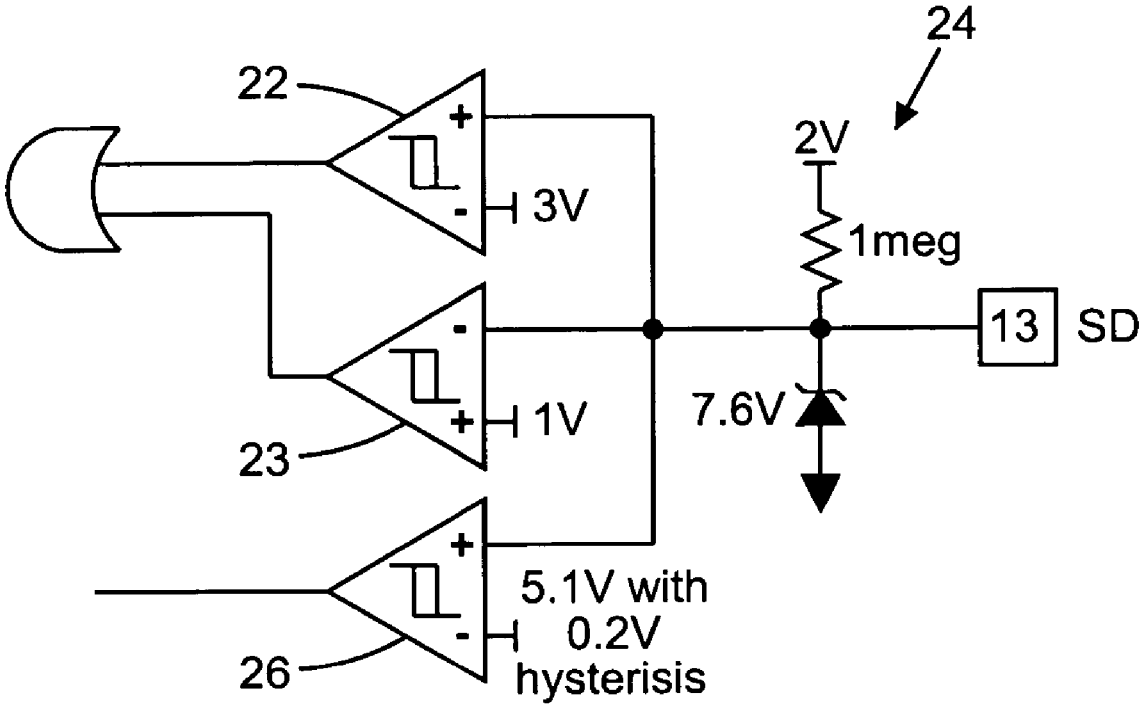
FIG. 2 is a simplified block diagram of a feedback sense used to realize the present invention.

Referring now to FIG. 2, input SD is illustrated as connected to a bias voltage and several comparators to detect various conditions. For example, comparators 22, 23 provide a threshold window of operation for the lamp to detect an end of life condition. That is, when the voltage on the SD pin is less than 1.0 volt or greater than 3.0 volts, an end of life condition is detected. During normal run mode, a healthy lamp produces a voltage between 1.0 and 3.0 volts, as referenced to the 2.0 volt bias voltage 24.

Another comparator 26 is used to detect a fault condition based on the voltage on the SD pin during different modes of operation. Each of comparators 22, 23 and 26 are Schmidt trigger comparators such that they exhibit hysteresis. In particular, comparator 26 exhibits 0.2 volts hysteresis on the basis of a 5.1 volt threshold. Accordingly, if the voltage on pin SD is less than 4.9 volts after power is turned on to the electronic ballast and the DC bus reaches an appropriate voltage, the lamp is determined to be operating properly and the electronic ballast continues with a normal start sequence. Preferably, comparator 26 is active during all modes to detect faults, such as a lamp fault or a lamp removal condition, where the voltage on pin SD rises above 5.1 volts. A bias voltage 24 is provided through a 1.0 MΩ resistor to obtain a high impedance input bias. To obtain a proper reading for EOL conditions, comparators 22 and 23 are preferably enabled when the electronic ballast and the lamp enter a normal run mode, at which point the voltage on pin SD should be stabilized for a healthy lamp between 1.0 and 3.0 volts.

Figure 3:
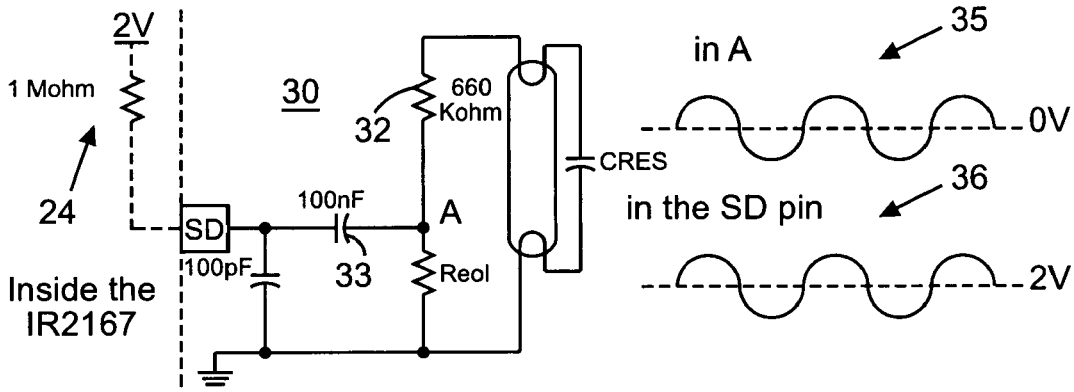
FIG. 3 is a circuit diagram of a feedback circuit to realize the advantages of the present invention.

Referring now to FIG. 3, an end of life feedback detection circuit is illustrated as circuit 30. Circuit 30 includes a node A that is the junction of a resistor 32, a capacitor 33 and a resistor REOL4. The value of resistor REOL4 is selected so that the lamp voltage during normal running operation produces a signal with a 1.5 volt PPK at node A. As a specific example, a T5/35W lamp operates with a resistor REOL4 having a value of 1.2 kΩ to provide the desired voltage at node A. As shown in waveform 35 in FIG. 3, the signal at node A has a zero volt offset and a sinusoidal shape. Pin SD has an internal voltage bias 24 with a value of 2.0 volts across a 1 MΩ impedance so that the voltage's signal on pin SD varies between 1.25 volts and 2.75 volts, due to the AC coupling of capacitor 33. The resulting waveform is illustrated as waveform 36, as derived from the lamp voltage waveform 35.

When an EOL condition is attained in the lamp, the lamp voltage may increase either symmetrically, meaning that there is similar deterioration in both an upper and lower cathode of the lamp, or asymmetrically, meaning that there is greater deterioration in one cathode than the other. The symmetrical voltage increase on the lamp is termed AC EOL because of the symmetry between the upper and lower cathode. The asymmetrical increase in lamp voltage is termed DC EOL because there is a bias toward one or the other of the cathodes with respect to the lamp voltage. The peak to peak voltage at pin SD increases with reference to voltage bias 24 in each the AC EOL or DC EOL cases until the positive peak voltage exceeds 3.0 volts and/or the negative peak voltage drops below 1.0 volt. These threshold values trigger the window comparator shutdown, as illustrated and described in FIG. 2, to indicate the need for lamp replacement and to protect the electronic ballast circuitry. The EOL thresholds can be adjusted by changing the value of REOL4 for specific applications. As a guideline, the end of life thresholds are typically 30% greater than or less than the voltage on the lamp to obtain appropriate EOL thresholds.

Figure 4A:
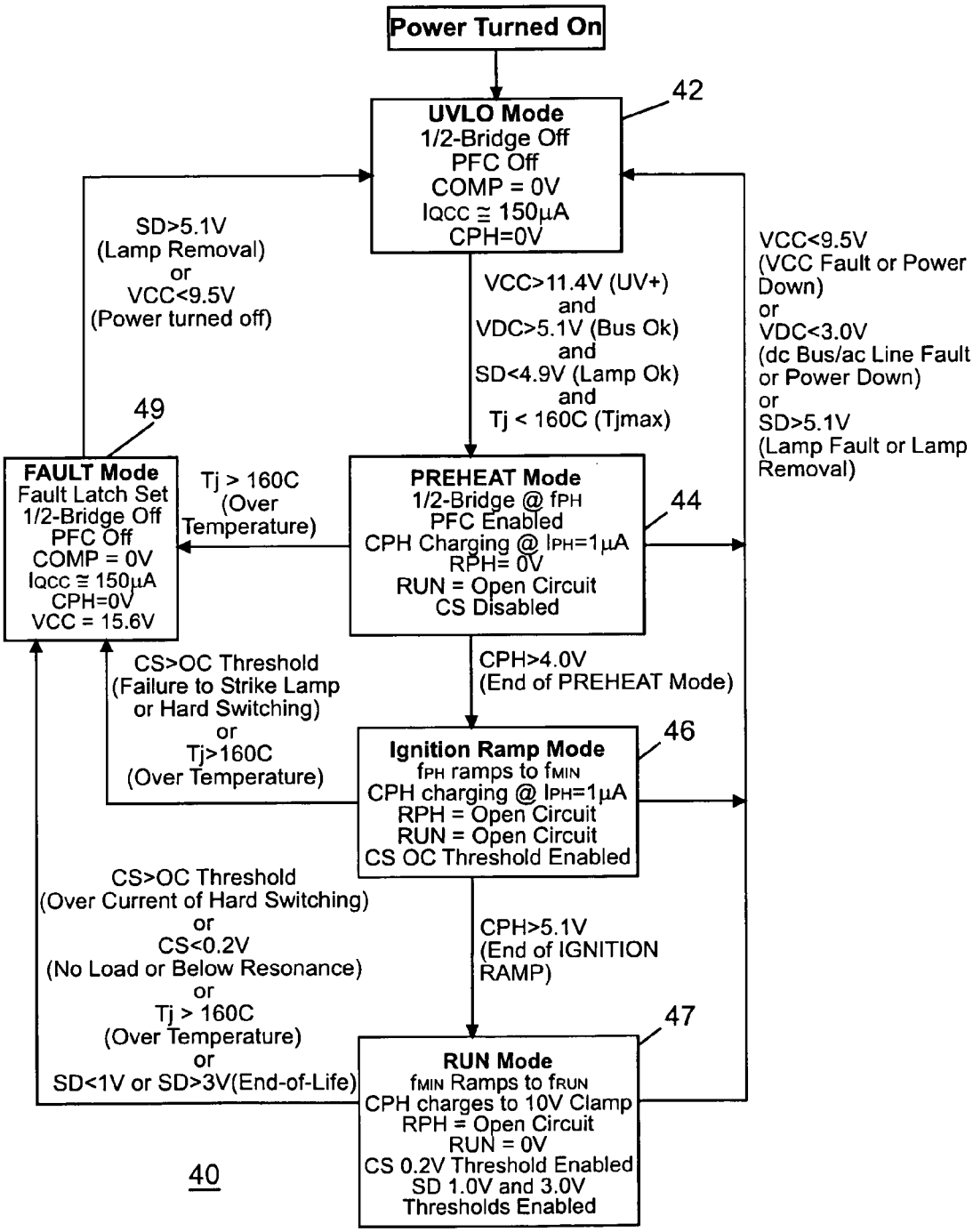
FIG. 4A is a block diagram of state operation of the electronic ballast control of FIG. 1.
Figure 4B:
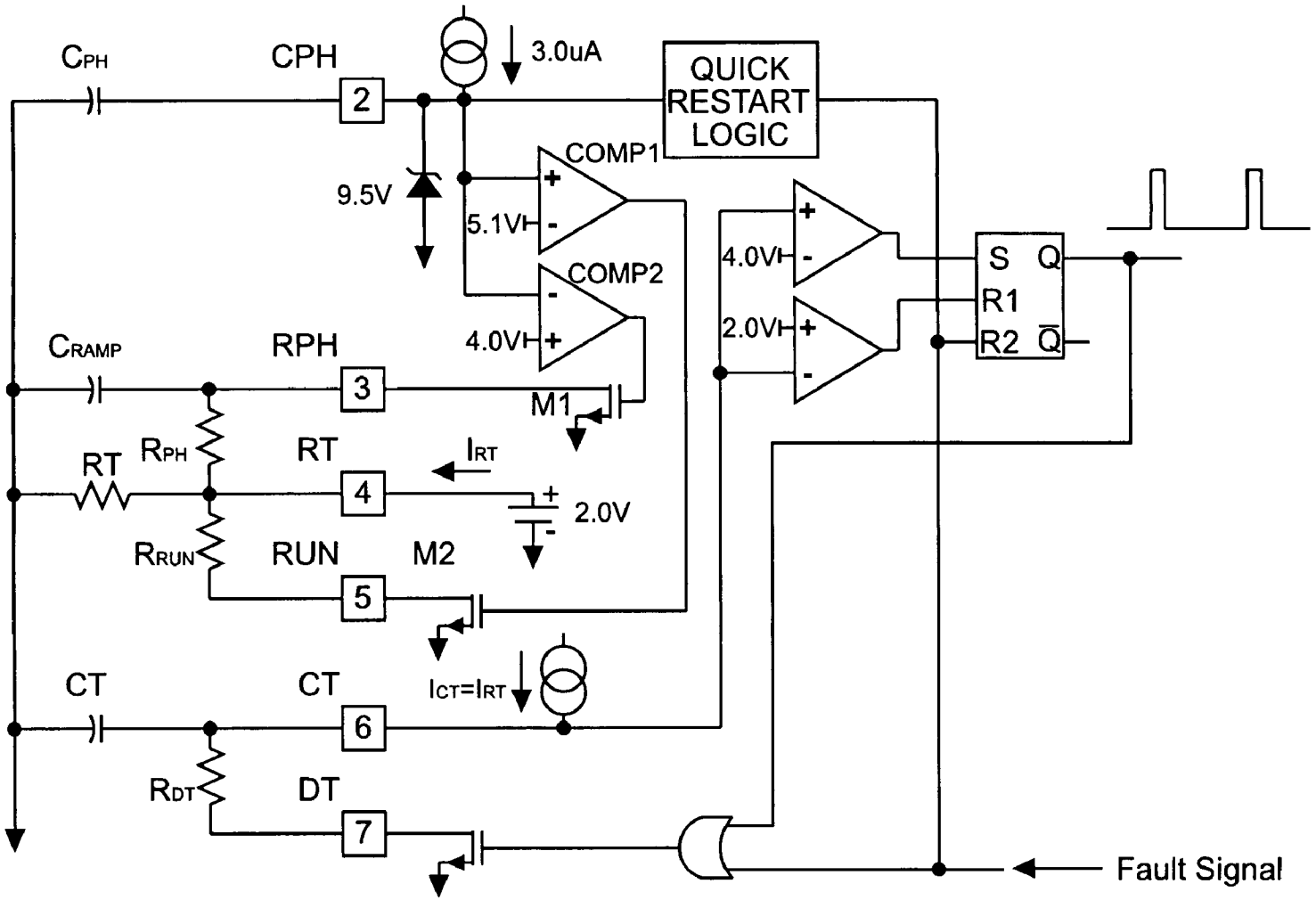
FIG. 4B is a circuit diagram for illustrating state switching operation.

Turning now to FIGS. 4A and 4B, state operation of the electronic ballast is illustrated. A stated diagram 40 illustrates how control IC 12 changes to different states based on sensed events and values to operate the lamp efficiently and take appropriate steps to protect the electronic ballast in the lamp in the event of fault conditions. Operation of the electronic ballast begins when power is turned on as control IC 12 enters a UVLO mode in a state 42. In UVLO mode, the switching half bridge is disabled, as is power factor correction, so that switches MHS, MLS and MPFC (FIG. 1) are not switched. In state 42, the value on pin COMP is zero volts, indicating an initial or reset condition for PFC control and DC bus regulation. During UVLO mode, power is provided on pin Vcc of control IC 12 as a small quiescent current Iqcc with a value of approximately 150 microamps. Similar to the value on pin COMP, pin CPH is discharged to zero volts to place control IC in an initial or restart state in UVLO mode.

During UVLO mode in state 42, power to the electronic ballast continues to build in the charge pump circuitry so that control IC 12 can change states from UVLO mode to preheat mode in state 44 once certain conditions are met. The conditions include the voltage on pin Vcc reaching a value greater than 11.4 volts, the upper UVLO threshold, and the bus voltage reaching a value greater than 5.1 volts to indicate the DC bus is operating properly and stabily. The transition from state 42 to state 44 also implies the voltage value on pin SD is less than 4.9 volts to indicate proper lamp operation, and an internal temperature sensor of control IC 12 indicates that the junction temperature of the IC is less than 160° C. Once all these conditions are met, control IC 12 transitions from UVLO mode in state 42 to preheat mode in state 44.

In preheat mode in state 44, preheat operation of the electronic ballast begins. The switching half bridge begins to oscillate at a preheat frequency and the PFC circuitry is enabled. Capacitor CPH (FIG. 4B) begins charging at a current of approximately 1 μA to determine the time period for the preheat mode. A resistor RPH is connected internally to COM, or zero volts, through a switch M1 to engage resistor RPH in parallel with resistor RT to contribute to determining the preheat mode oscillation frequency. Pin RUN is set internally to an open circuit by non-conducting switch M2 to obtain the desired combination of resistor and capacitor operation to establish preheat frequency and timing to specify the parameters of preheat mode. In addition, in state 44, pin CS (FIG. 1) is disabled to prevent the detection of overcurrent faults during preheat mode. Various transients and voltage and current levels in the electronic ballast during preheat mode may temporarily cause an overcurrent condition, the spurious indication of which is prevented by disabling pin CS.

State operation of control IC 12 transitions from preheat mode state 44 to an ignition ramp mode state 46 once the voltage on pin CPH reaches a value greater than 4.0 volts, as indicated on comparator COMP 2. A pin RPH is disconnected from ground, or becomes an open circuit, through switch M1 turning off. In ignition ramp mode state 46, the oscillation frequency ramps from the preheat frequency toward the minimum frequency of the electronic ballast to attempt lamp ignition. During state 46, the voltage on capacitor CPH continues to increase as a charging current of approximately 1 μA is delivered to capacitor CPH. In addition, both pin RPH and pin RUN are set to open circuit conditions by non-conducting switches M1, M2 to establish the ramp time by charging capacitor CRAMP through resistor RPH. As capacitor CRAMP charges, the oscillation frequency determined by resistor RT, capacitor CT and resistor RDT approaches the minimum oscillation frequency. The minimum frequency is near the resonance frequency of the load circuit producing a large voltage and current, to cause the lamp to ignite. During ignition ramp mode state 46, the overcurrent threshold circuitry on pin CS is enabled to detect if there is a failure to ignite the lamp, or if there is hard switching in the switching half bridge. In the event of an overcurrent fault, control IC 12 transitions from state 46 to fault mode state 49 to disable the switching half bridge and place the electronic ballast and lamp in a safe condition as described in greater detail below.

Control IC 12 transitions from ignition ramp mode state 46 to run mode state 47 once the voltage on pin CPH is greater than 5.1 volts as indicated on comparator COMP2, which controls switch M2 to couple resistor RRUN to ground. Accordingly, in run mode state 47 the oscillation frequency ramps from a minimum frequency to a run frequency determined by resistors RT, RRUN and RDT and capacitor CT. Capacitor CPH charges to a 10 volt level that is clamped, and is discharged to zero volts in the event of a fault or a transition to UVLO mode state 42, such as in the case of power down or restart. While pin RPH continues to be placed in an open circuit condition, pin RUN is connected internally to ground to permit current flow through resistor RRUN. Also during run mode state 47, pin CS is enabled for a 0.2 threshold that is used to determine when there is no load or switching operation below a resonance frequency. Also during run mode state 47, pin SD is enabled for the window thresholds of 1.0 volts and 3.0 volts for end of life detection during normal run mode operation.

Control IC 12 transitions from states 44, 46 or 47 to UVLO mode state 42 in the event of a fault on a supply voltage, or a power down, or if the DC bus falls below a threshold level for proper operation, as may be the case in a power down as well. In addition, the transition to UVLO mode state 42 may occur if the voltage on pin SD becomes greater than 5.1 volts, which indicates a lamp fault or the absence of the lamp.

Control IC 12 transitions from run mode state 47 to fault mode state 49 in the event of an overcurrent detection based on the sent signal on pin CS, or if the voltage on pin CS falls below the specified threshold, for example 0.2 volts, which indicates a no load or below resonance operation. A transition from run mode state 47 to fault mode state 49 also occurs if the voltage on pin SD falls outside of the EOL threshold window established by the exemplary thresholds of 1.0 volts and 3.0 volts. All three states 44, 46 and 47 also transition to fault mode state 49 in the event of an overtemperature fault in which a junction temperature internal to control IC 12 senses a temperature of greater than 160° C., for example.

In fault mode state 49, control IC 12 operates to protect the electronic ballast components and the lamp from damage that may occur during detected fault conditions. A fault latch is set to indicate the occurrence of a fault, which is reset once power is cycled or if there is a lamp exchange. During fault mode state 49, the switching half bridge is disabled, as is the PFC circuit, meaning that the DC bus is no longer regulated, as indicated by pin COMP going to zero volts. In order to maintain operation of the control IC 12, a quiescent current is supplied to supply voltage pin Vcc of approximately 150 μA. Fault mode state 49 also provides for a reset of the preheat timing capacitor by setting pin CPH to zero volts. Vcc is also set to a specific value, for example 15.6 volts, to maintain operation of the control for the electronic ballast without actively operating the power components.

Control IC 12 transitions from fault mode state 49 to UVLO mode state 42 when the voltage is applied to pin Vcc drops below a specific value, for example 9.5 volts, or if the voltage on pin SD increases to above 5.1 volts. The increase of the voltage on pin SD indicates a lamp absence, so the transition to UVLO mode state 42 permits an automatic restart of the electronic ballast if the lamp is replaced with a fresh lamp.

Figure 5:
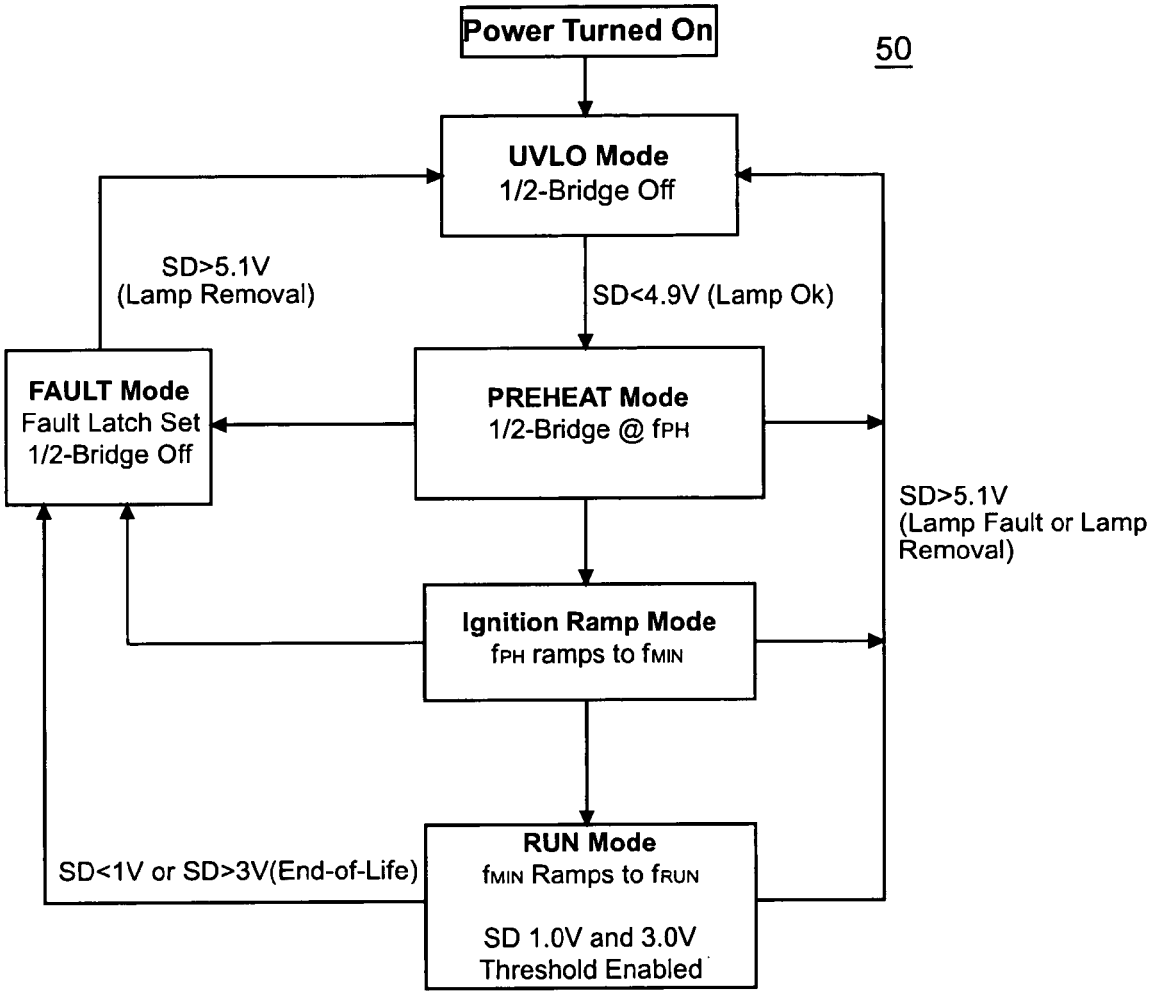
FIG. 5 is a block diagram of a state operation of the feedback circuit of FIG. 2.

Referring now to FIG. 5, the particular features of the operation of pin SD is highlighted in an abbreviated state diagram 50. The particular features of the SD pin provide for determining whether there is a lamp fault, if the lamp is removed or if an EOL condition is detected. If the voltage on pin SD is less than 4.9 volts during startup, i.e., control IC 12 is in UVLO mode, the lamp is determined to be operating properly and the electronic ballast continues with the startup sequence. EOL detection on pin SD is enabled during run mode to compare the lamp voltage against a threshold window that is obtained with a voltage bias, as discussed above with reference to FIG. 2. When the voltage on pin SD increases to above 5.1 volts, a lamp fault or lamp removal is indicated and the appropriate transitions in the state diagram occur. In accordance with the present invention, the transitions in state diagram 50 related to a fault indicated on pin SD are advantageously used to indicate a variety of lamp faults. That is, when the voltage on pin SD is bigger than the fault threshold of 5.1 volts, for example, a shutdown response occurs that can be used as a reaction to a number of lamp faults. Accordingly, if a lamp fault occurs, a voltage greater than the fault threshold can be applied to pin SD to cause control IC 12 to transition to a fault state. The circuitry for driving the voltage on pin SD above the threshold is described in greater detail below, with an exemplary embodiment illustrated in FIG. 7.

During startup, control IC 12 is in a micro-power mode and draws a very small current, such as a quiescent current of 150 μA. By determining the voltage on pin SD in UVLO mode, the oscillator can be prevented from starting until the voltage on pin SD is less than a threshold, such as 4.9 volts, for example. By determining the voltage on the lamp prior to initiating operation of the electronic ballast i.e., prior to preheat and ignition, ballast control IC 12 can determine that the lamp is connected and that the filaments are intact. The voltage on pin SD is continually monitored during preheat and ignition modes to determine if a lamp removal or open filament condition occurs. These fault conditions are detected by comparing the voltage on pin SD against a 5.1 volt threshold, for example. Control IC 12 returns to UVLO mode if the voltage on pin SD exceeds the threshold. By comparing the voltage on pin SD against a threshold, ballast control IC 12 can detect the absence of a lamp, or if a lamp filament is in an open circuit condition. In the event of a lamp removal, control IC 12 returns to UVLO mode as the voltage on pin SD exceeds the appropriate threshold, and stays in UVLO mode until all the startup conditions are met to attempt a restart sequence. If all other conditions are met with respect to proper operation of the lamp ballast, with the exception of the voltage on pin SD being above the specified threshold, the start sequence can automatically begin once a lamp is replaced in the electronic ballast circuit, where upon the voltage on pin SD drops below another threshold, such as 4.9 volts, for example. Once the voltage on pin SD falls below the threshold to indicate the presence of a lamp in good condition, the start sequence can begin by initializing the oscillator in the preheat mode to begin starting the lamp.

Referring now to FIGS. 6A–6D, a number of lamp faults detected by control IC 12 on pin SD are illustrated as voltages derived from the lamp under different operating conditions and in the presence of different faults. As discussed above with respect to the circuit illustrated in FIG. 1, pin SD has an internal voltage bias of approximately 2.0 volts across a 1 MΩ impedance, for example, to permit the signal on pin SD to vary between 1.25 volts and 2.75 volts based on the AC coupling of capacitor 33 (FIG. 3). When the lamp reaches an EOL condition, the lamp voltage may increase symmetrically, i.e., in a positive and negative direction at the same time, due to similar deterioration in the upper and lower cathodes. This type of end of life condition is referred to as an AC end of life condition due to the symmetrical shape of the lamp voltage waveform. Alternately, an EOL condition may be indicated as an asymmetric increase in the lamp voltage, i.e., the lamp voltage may be greater in a positive direction than in a negative direction or vice versa. The asymmetric EOL condition is typically due to deterioration that is greater in one cathode than another. This type of asymmetric deterioration of the cathodes is referred to as a DC EOL condition because of the asymmetric shape of the lamp voltage waveform that gives the impression of a DC offset in the sinusoidal waveform.

In either the AC or DC EOL condition, the peak to peak voltage on pin SD increases with reference to the two volt DC offset provided by internal voltage bias until the positive peak exceeds three volts, for example, and/or the negative peak drops below one volt, for example. When the peak to peak voltage at pin SD exceeds the boundaries of these thresholds, also referred to as a window comparator, a shutdown is triggered to indicate and EOL condition. As noted above with respect to FIG. 3, the threshold values may be modified by changing the value of resistor REOL4 coupled to the lamp.

Figures 6A, 6B, 6C, 6D:
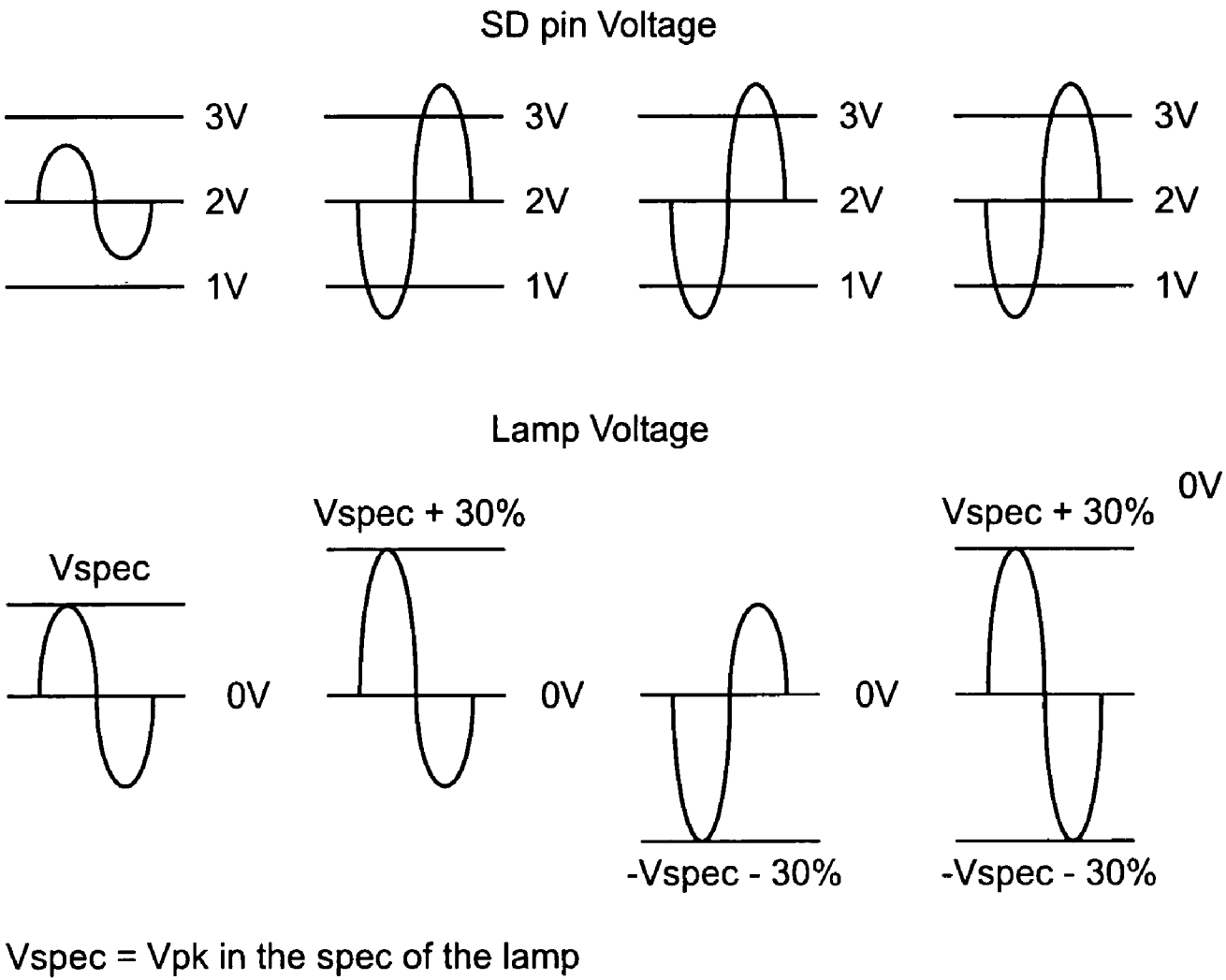
FIGS. 6A–6D are graphical illustrations of the operation of the feedback circuit according to the present invention.

In FIG. 6A, the lamp is operating properly and within the specification voltage, VSPEC, in which case no EOL condition is indicated. In FIG. 6B, the lamp voltage with a deteriorated upper cathode is shown with a positive going peak voltage that is approximately 30% greater than the specified voltage VSPEC. This condition is detection on pin SD as the voltage exceeds the thresholds for normal operation of 1.0 and 3.0 volts in both the negative and positive going directions. FIG. 6C shows a lamp voltage in the condition where a lower cathode of the lamp experiences much greater deterioration than the upper cathode, indicated as a greater negative going voltage peak with a value of 30% beyond the negative voltage specification—VSPEC. This condition is indicated by the voltage on pin SD exceeding the thresholds of the window comparator to indicate an EOL condition. The cathode deterioration illustrated as asymmetrical lamp voltages in FIGS. 6B and 6C are referred to as DC EOL conditions because of the apparent DC offset observed on the lamp voltage. In FIG. 6D, a lamp voltage is illustrated from a lamp with cathodes that are similarly deteriorated. Because of the similar deterioration in the cathodes, the lamp voltage waveform appears symmetrical and produces a peak voltage in both a positive and negative going direction of approximately 30% more than the specified voltage VSPEC. This end of life condition is detected by the voltage on pin SD exceeding the thresholds of the window comparator for the EOL condition. Because of the symmetrical nature of the lamp voltage waveform, this EOL condition is referred to as AC EOL.

This technique for detecting an EOL condition is relatively simple to realize in control IC 12, as well as being relatively inexpensive to manufacture. Although, the EOL detection circuitry is straightforward and easily implemented, it still is able to detect a number of failure modes for cathode deterioration in the fluorescent lamp.

Because the reaction of the voltage on pin SD is symmetrical with respect to negative and positive going voltages, even when the lamp voltage is non-symmetrical with respect to positive and negative going voltages, the EOL detection circuitry may be further simplified. Because the peak to peak voltage at pin SD increases with reference to the internal voltage bias in either AC EOL or DC EOL conditions, regardless of which cathode experiences greater deterioration, the EOL detection function can be implemented with a single comparator with a threshold at one of the thresholds for the window comparator. For example, the window comparator illustrated in FIG. 1 composed of comparators 22, 23 can be replaced with a single comparator with a threshold value of 1.0 volt or 3.0 volts, for example. Accordingly, the external circuitry illustrated in FIG. 3 provides an appropriate voltage signal to pin SD to detect an EOL condition based on deterioration in any of the cathodes of the lamp.

With respect to the term "threshold," a lower or upper value may be represented. Accordingly, a value compared against a threshold may be defined as exceeding the threshold in either an upper or lower relative direction. For example, if the threshold is a negative value, the value to be compared against the threshold can exceed the threshold by being more positive or by being more negative than the threshold value. A threshold may be an upper limit or a lower limit, and indicates that a comparison with another value will result in one output state when the compared value is above the threshold, and another output state when the compared value is below the threshold.

Figure 7:
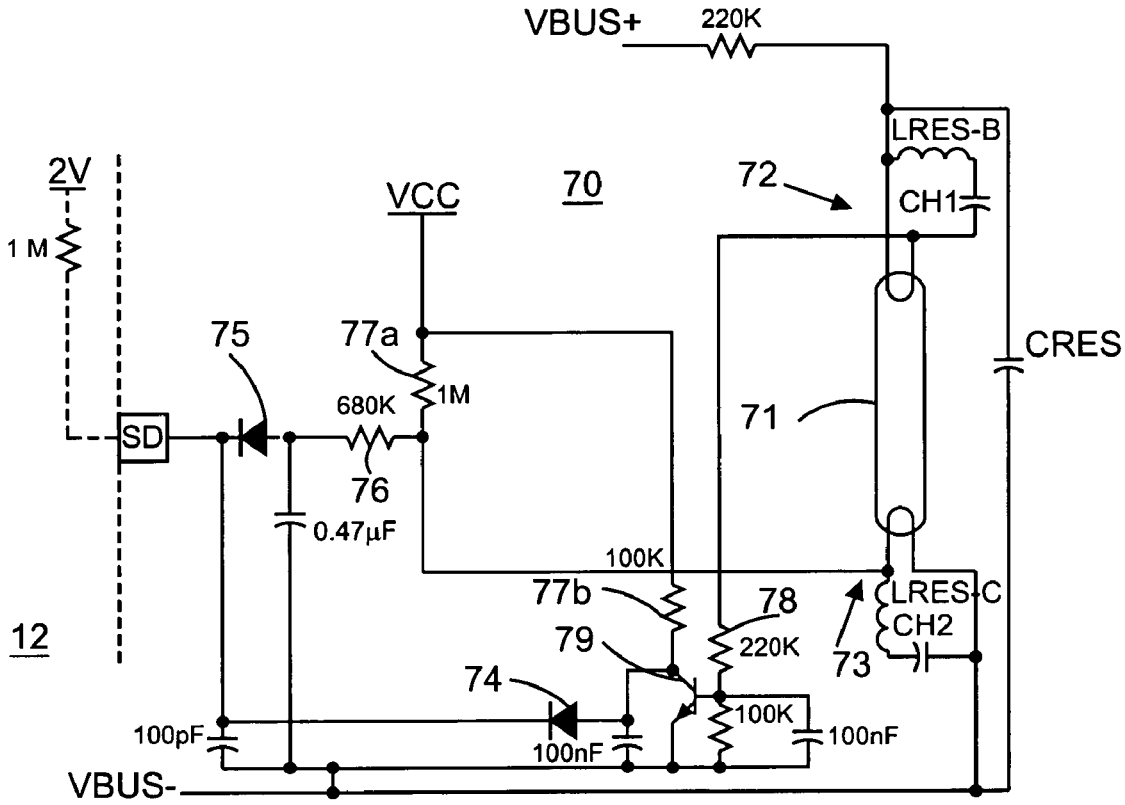
FIG. 7 is a circuit diagram of a fault detection circuit according to the present invention.

Referring now to FIG. 7, an open filament detection circuit external to an electronic ballast control is illustrated as detection circuit 70. Detection circuit 70 includes connections to upper and lower cathodes 72, 73 of lamp 71. Detection circuit 70 permits measurement of lamp parameters at cathodes 72, 73 to detect conditions in lamp operation that may not otherwise be detected on the basis of a current sense feedback alone. For example, an open upper filament or broken upper cathode can be detected by current sense pin CS through the detection of an overcurrent condition or hard switching in the switching half bridge of the electronic ballast. Typically, these measurements are made during preheat mode where current mode preheat operation is used. In such a situation, an overcurrent detection is suitable to detect an open filament or broken cathode in either the upper or lower cathodes of the lamp. A connection to a lower lamp filament to detect the absence of the lamp and provide for an auto restart sequence after a lamp is replaced provides enough additional functionality such that a connection to the upper cathode of the lamp is not necessary in the case of current mode preheat operation.

However, in the case of voltage mode preheat operation, or when the electronic ballast is to be used in a low voltage lighting design, an open filament in the upper cathode may not cause an overcurrent condition during a preheat mode and ignition mode. This problem can be solved by providing a connection to the upper cathode to detect the condition of the upper cathode and filament of the lamp.

In accordance with detection circuit 70, when the lower lamp filament is intact, the anode of diode 75 is held close to the negative DC bus rail, typically zero volts, due to the small resistor 76 and the small resistance of lower cathode 73. Accordingly, diode 75 does not conduct when the filament of cathode 73 is intact. As diode 75 does not conduct, the voltage on pin SD is mainly influenced by the internal voltage bias to remain substantially at 2.0 volts, for example, for EOL detection purposes. If the filament at cathode 73 becomes an open circuit, the anode of diode 75 is pulled up to voltage Vcc through pull up resistor 77A, which may have a value of 1 MΩ for example. As the anode of diode 75 is pulled up to voltage Vcc, diode 75 begins to conduct and pulls the voltage on pin SD up to voltage Vcc, which is above the 5.1 volt threshold that is used to detect a lamp fault through the circuitry in control IC 12. Once the voltage on pin SD rises above the shutdown threshold, the shutdown mechanism is triggered and the switching half bridge stops oscillating and control IC is placed in either a fault mode or UVLO mode. In this situation, even if power to the electronic ballast is cycled, the voltage on pin SD will continue to be greater than the shutdown threshold due to the open circuit filament, which maintains the fault status of the electronic ballast. In such a circumstance, control IC 12 remains in UVLO mode indefinitely. Once lamp 71 is changed with a healthy lamp, the lower filament at cathode 73 again has a small resistance and the voltage on pin SD drops below 4.9 volts, thereby permitting the lamp to be restarted automatically without the need to reset the input AC line power after lamp replacement.

The state of upper cathode 72 is detected with a connection to the base of transistor 79. Transistor 79 remains switched on as long as the upper filament is intact and supplying current through resistor 78 from the power rail of the DC bus. When transistor 79 is on, the anode of diode 74 is held close to zero volts because of the small voltage drop across the transistor 79 when it is conducting. The small voltage on the anode of diode 74 does not impact the voltage on pin SD to any great extent, so that the voltage on pin SD remains at approximately 2.0 volts under normal operating circumstances. If the upper filament in cathode 72 becomes an open circuit, the current path to the base of transistor 79 is broken and transistor 79 turns off. When transistor 79 turns off, the anode of diode 74 is pulled up to voltage Vcc through resistor 77B, so that diode 74 conducts and pulls the voltage on pin SD up to voltage Vcc and beyond the shutdown threshold established for the voltage on pin SD. As the voltage on pin SD increases beyond the shutdown threshold, control IC 12 turns off the switching half bridge and shuts down operation of the electronic ballast. The voltage on pin SD will continue to remain above the shutdown threshold according to circuit 70 until a current path is provided to the base of transistor 79, i.e., the lamp is replaced. According to this scenario, replacement of lamp 71 with a healthy lamp permits an automatic restart of the electronic ballast without the need to cycle power, as discussed above.

Circuit 70 therefore permits the detection of faults in lamp 71 based on a voltage applied to pin SD of control IC 12. By providing a detection circuit in the electronic ballast, an open filament and broken cathode in either the upper or lower cathode of the lamp can be detected in an electronic ballast operating with voltage mode preheat or for a low voltage application. Accordingly, a number of electronic ballasts and lamp faults can be detected and appropriate responses may be taken to prevent damage to the electronic ballast or indicate the need to replace the lamp based on an increased voltage on pin SD or current sensed on pin CS. All these features can be accomplished with only two pins for feedback sensing, pin CS for current detection in the switching half bridge and pin SD for detecting lamp status and condition. Among the fault detected are DC EOL, AC EOL, lamp absence, broken lamp, open filament, broken cathode, overcurrent, hardswitching and failure to ignite. These features permit an auto restart of the electronic ballast under certain conditions, such as the replacement of a failed lamp with a healthy lamp. The features provided through threshold detection on pin SD are achieved with a simple set of comparators and a voltage bias, with the appropriate circuitry attached to the lamp to trigger the SD circuitry in the event of a lamp fault.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electronic ballast control operable to detect faults in a lamp driven by an electronic ballast, the control comprising:

a comparator having a first input coupled to the lamp to obtain a lamp parameter value, and having a second input coupled to a threshold value for comparison with the lamp parameter value;

a shutdown circuit coupled to an output of the comparator for shutting down the electronic ballast based on selective application of the output of the comparator; and an AC coupling element between the lamp and the comparator, whereby the lamp parameter value is AC coupled to the first input;

wherein said electronic ballast control is comprised in an integrated circuit and said first input is coupled to the lamp by a single pin of said integrated circuit;

said shutdown circuit being responsive to said first input at said single pin for shutting down said electronic ballast in response to any one of a lamp fault, lamp removal and an end-of-life condition.

2. The control according to claim 1, further comprising a voltage bias coupled to the first input to provide a DC offset to the lamp parameter value applied to the input of the comparator.

3. The control according to claim 1, wherein the lamp parameter value represents a voltage value at each cathode of the lamp.

4. The control according to claim 3, wherein the lamp parameter value is indicative of a deterioration of one or more cathodes in the lamp.

5. The control according to claim 1, further comprising an impedance element connected to the AC coupling element to condition the lamp parameter value in relation to a characteristic of the lamp.

6. The control according to claim 1, wherein the threshold value represents a nominal lamp parameter value increased or decreased by a specified percentage.

7. The control according to claim 1, wherein said lamp fault includes open upper filament, open lower filament, broken upper cathode and broken lower cathode.

8. The control according to claim 7, wherein said end-of-life condition includes AC end of life and DC end of life.

9. The control according to claim 1, wherein said end-of-life condition includes AC end of line and DC end of life.

10. A feedback control circuit for an electronic ballast for detecting a status of a lamp driven by the electronic ballast, the control circuit comprising:

a comparator having a first input coupled to the lamp and a second input coupled to a threshold value related to a shutdown characteristic, and operable to change states when a value at the first input crosses the threshold value;

a state switching element coupled between the first input and the lamp and operable to switch states between a first state and a second state based on a status of the lamp; and the state switching element operable to drive the first input switches between the switching element first and second states to change a state of the comparator, whereby the electronic ballast is enabled or disabled;

wherein said feedback control circuit is comprised in an integrated circuit and said first input is coupled to said state switching element by a single pin of said integrated circuit;

said status of said lamp detected by said feedback control circuit via said single pin includes any one of a lamp fault, lamp removal and an end-of-life condition.

11. The control according to claim 10, wherein the state switching element is a diode.

12. The control according to claim 10, wherein the state switching element is coupled to a lamp filament and changes state based on a change in state of the conduction of the lamp filament.

13. The control according to claim 10, further comprising a second state switching element coupled to the lamp and the first input.

14. The control according to claim 13, wherein the second state switching element is a diode.

15. The control according to claim 13, further comprising a switch coupled to a lamp filament and to the second state switching element and operable to cause the state switching element to change states based on a state change of the lamp filament.

16. The control according to claim 10, wherein said lamp fault includes open upper filament, open lower filament, broken upper cathode and broken lower cathode.

17. The control according to claim 16, wherein said end-of-life condition includes AC end of life and DC end of life.

18. The control according to claim 10, wherein said end-of-life condition includes AC end of life and DC end of life.

19. A method for detecting a lamp fault on a lamp driven by an electronic ballast comprising a control integrated circuit, comprising:

detecting a closed circuit through a filament of the lamp with a state switching element to establish a non-fault lamp state;

changing the state of the state switching element when the lamp filament becomes an open circuit to indicate a lamp fault state; and shutting down the electronic ballast via a signal from the state switching element at a single pin of the control IC, in the event of a change in the state switching element based on an open circuit filament.

20. The method according to claim 19, further comprising driving a comparator input across a threshold value based on the change in state of the state switching element to thereby cause the electronic ballast to be shut down.

21. The method according to claim 19, further comprising detecting a state of a plurality of lamp filaments and changing the state of the state switching element if any of the filaments become an open circuit.

* * * * *